US011256198B1

(12) United States Patent
Yoshioka et al.

(10) Patent No.: US 11,256,198 B1
(45) Date of Patent: Feb. 22, 2022

(54) TRANSFER DEVICE AND IMAGE FORMING APPARATUS

(71) Applicant: FUJIFILM Business Innovation Corp., Tokyo (JP)

(72) Inventors: Tomoaki Yoshioka, Kanagawa (JP); Yoko Miyamoto, Kanagawa (JP); Toshiaki Baba, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/337,526

(22) Filed: Jun. 3, 2021

(30) Foreign Application Priority Data

Aug. 12, 2020 (JP) ..... JP2020-136477

(51) Int. Cl.
*G03G 15/16* (2006.01)
*G03G 15/01* (2006.01)

(52) U.S. Cl.
CPC ..... *G03G 15/1615* (2013.01); *G03G 15/0189* (2013.01); *G03G 15/162* (2013.01)

(58) Field of Classification Search
CPC ..... G03G 15/1615; G03G 15/162; G03G 15/1655
USPC ..... 399/303, 304
See application file for complete search history.

(56) References Cited

U.S. PATENT DOCUMENTS 6,151,477 A * 11/2000 Takeuchi et al. .. G03G 15/0131 399/303
2021/0294246 A1* 9/2021 Yoshioka et al. ..... G03G 15/16

FOREIGN PATENT DOCUMENTS

JP 58-005769 A 1/1983

* cited by examiner

*Primary Examiner* — William J Royer
(74) *Attorney, Agent, or Firm* — Sughrue Mion, PLLC

(57) ABSTRACT

A transfer device includes: an annular transfer belt including an outer surface, a toner image being transferred to the outer surface of the annular transfer belt; a transfer unit including a transfer cylinder; and a facing roller member that is in contact with an inner surface of the transfer belt, in which the transfer cylinder includes a base material, and a surface layer wound around an outer circumference of the base material, the surface layer being replaceable with respect to the base material, the transfer cylinder has a transfer region where the toner image is transferred from the transfer belt to a recording medium in a state where the recording medium is sandwiched between the transfer cylinder and the outer surface of the transfer belt, the surface layer includes an elastic layer, the surface layer has a thickness of 6.0 mm or more and 10 mm or less and an Asker C hardness of 45° or more and 65° or less, and the facing roller member faces the transfer cylinder in the transfer region.

14 Claims, 7 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2020-136477 filed Aug. 12, 2020.

BACKGROUND

(i) Technical Field

The present disclosure relates to a transfer device and an image forming apparatus.

(ii) Related Art

JP-A-58-005769 discloses a transfer device. The transfer device includes a transferred material transporting unit, a gripper piece, and a switch member. The gripper piece is attached to the transporting unit. The gripper piece is pivotally supported by a rotating shaft. The gripper piece rotates relative to a base member. The gripper piece holds a leading end side of the transferred material. The switch member is attached to a base member side. In order to detect whether the transferred material is in the gripper, a part of a switch member position in the gripper piece is cut out.

SUMMARY

Aspects of non-limiting embodiments of the present disclosure relate to providing a transfer device including: an annular transfer belt including an outer surface, a toner image being transferred to the outer surface of the annular transfer belt; a transfer unit including a transfer cylinder; and a facing roller member that is in contact with an inner surface of the transfer belt, in which the transfer cylinder includes a base material, and a surface layer wound around an outer circumference of the base material, the surface layer being replaceable with respect to the base material, the transfer cylinder has a transfer region where the toner image is transferred from the transfer belt to a recording medium in a state where the recording medium is sandwiched between the transfer cylinder and the outer surface of the transfer belt, and the facing roller member faces the transfer cylinder in the transfer region, the transfer device that can achieve both a replaceability of the surface layer and an image transferability of the surface layer in the transfer cylinder as compared to a case where the surface layer in the transfer cylinder includes an elastic layer and the surface layer has a surface roughness Rz of more than 25 μm, an Asker C hardness of less than 45° or more than 65°, a volume resistance of less than 6.0 (log Ω) or more than 8.5 (log Ω), or a thickness of more than 10 mm.

Also, aspects of non-limiting embodiments of the present disclosure relate to providing a transfer device including: an annular transfer belt including an outer surface, a toner image being transferred to the outer surface of the annular transfer belt; a transfer unit including a transfer cylinder; and a facing roller member that is in contact with an inner surface of the transfer belt, in which the transfer cylinder includes a base material, and a surface layer wound around an outer circumference of the base material, the surface layer being replaceable with respect to the base material, the transfer cylinder has a transfer region where the toner image is transferred from the transfer belt to a recording medium in a state where the recording medium is sandwiched between the transfer cylinder and the outer surface of the transfer belt, and the facing roller member faces the transfer cylinder in the transfer region, the transfer device that can achieve both a replaceability of the surface layer and an image transferability of the surface layer in the transfer cylinder as compared to a case where the surface layer in the transfer cylinder has a single-layer structure including a foamed conductive elastic layer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transfer device including: an annular transfer belt including an outer surface, a toner image being transferred to the outer surface of the annular transfer belt; a transfer unit including a transfer cylinder; and a facing roller member that is in contact with an inner surface of the transfer belt, in which the transfer cylinder includes a base material, and a surface layer wound around an outer circumference of the base material, the surface layer being replaceable with respect to the base material, the transfer cylinder has a transfer region where the toner image is transferred from the transfer belt to a recording medium in a state where the recording medium is sandwiched between the transfer cylinder and the outer surface of the transfer belt, the surface layer includes an elastic layer, the surface layer has a thickness of 6.0 mm or more and 10 mm or less and an Asker C hardness of 45° or more and 65° or less, and the facing roller member faces the transfer cylinder in the transfer region.

BRIEF DESCRIPTION OF THE DRAWINGS

Exemplary embodiment(s) of the present disclosure will be described in detail based on the following figures, wherein.

DETAILED DESCRIPTION

Figure 1:
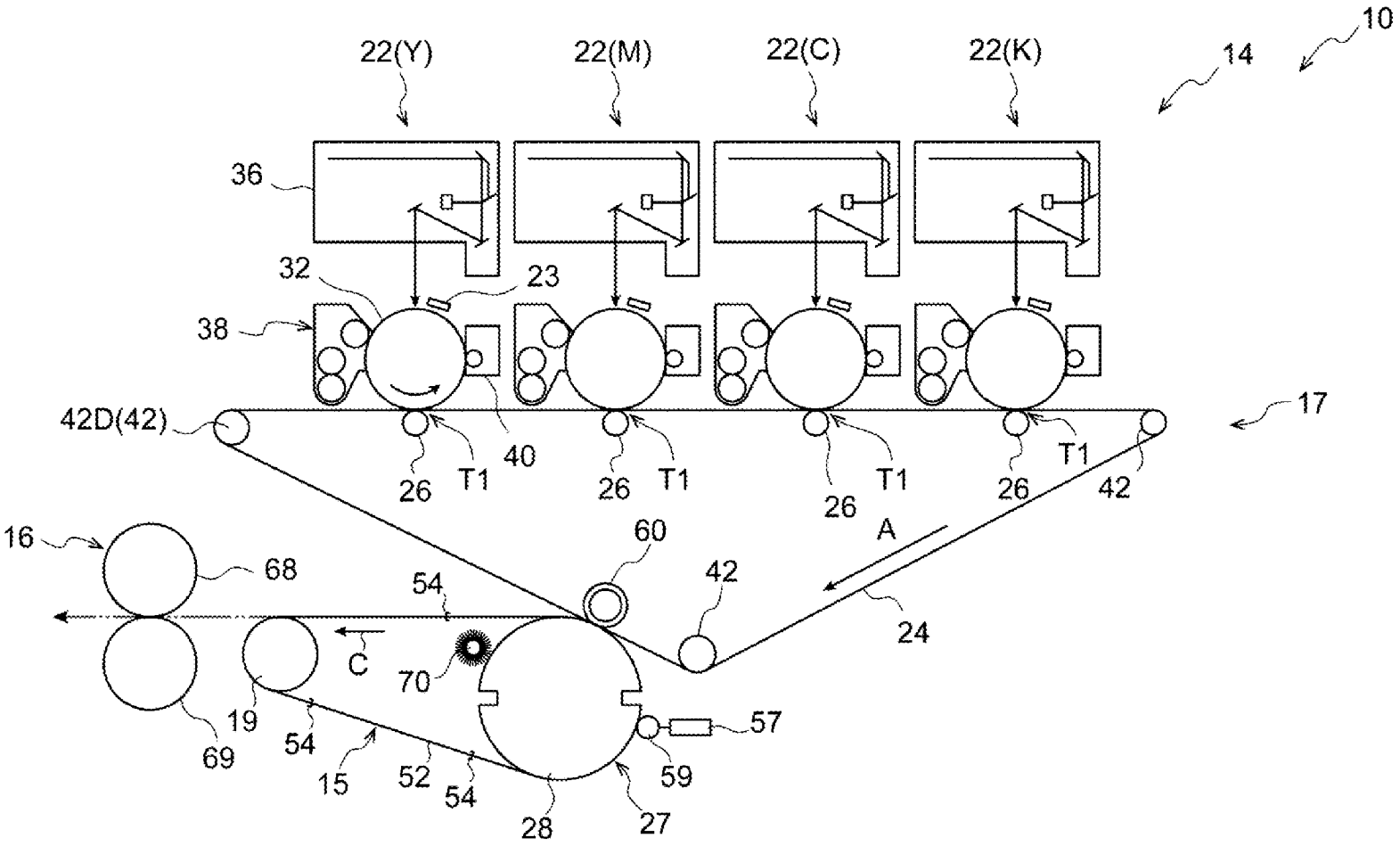
FIG. 1 is a schematic view showing an image forming apparatus according to an exemplary embodiment.

Hereinafter, exemplary embodiments of the present disclosure will be described. The exemplary embodiments shown below are examples of exemplary embodiments of the present disclosure, and the present disclosure is not limited to the following embodiments.

In the present specification, when numerical ranges are described stepwise, an upper limit value or a lower limit value of one of the numerical ranges may be replaced with an upper limit value or a lower limit value of another one of the numerical ranges. In the numerical ranges described in the present specification, an upper limit value or a lower limit value of one of the numerical ranges may be replaced with a value shown in examples.

Transfer Device

A transfer device according to first and second exemplary embodiments includes an annular transfer belt including an outer surface, a toner image being transferred to the outer surface of the annular transfer belt; a transfer unit including a transfer cylinder; and a facing roller member that is in contact with an inner surface of the transfer belt. The transfer cylinder includes a base material, and a surface layer wound around an outer circumference of the base material, the surface layer being replaceable with respect to the base material. The transfer cylinder has a transfer region where the toner image is transferred from the transfer belt to a recording medium in a state where the recording medium is sandwiched between the transfer cylinder and the outer surface of the transfer belt. The facing roller member faces the transfer cylinder in the transfer region.

In the transfer device according to the first exemplary embodiment, the surface layer of the transfer cylinder includes an elastic layer. The surface layer has a surface roughness Rz of 25 μm or less, an Asker C hardness of 45° or more and 65° or less, a volume resistance of 6.0 (log Ω) or more and 8.5 (log Ω) or less, and a thickness of 10 mm or less.

Further, in the transfer device according to the second exemplary embodiment, the surface layer of the transfer cylinder has a foamed conductive elastic layer and a non-foamed conductive elastic layer in order from a base material side. A thickness of the foamed conductive elastic layer is larger than a thickness of the non-foamed conductive elastic layer.

As described above, in the transfer device including the transfer belt, the transfer unit, and the facing roller member, a toner image on the outer surface of the transfer belt is transferred to a recording medium in a transfer region formed by a transfer belt, a transfer unit (specifically, a transfer cylinder), and a facing roller member.

Further, as described above, in the transfer cylinder of the transfer unit, when the surface layer wound around the outer circumference of the base material is replaceable, only the surface layer may be replaced when the surface layer is deteriorated or the like. As a result, the transfer device has, for example, an advantage that a size of the transfer cylinder may be increased.

In the transfer device having the configuration, since an electric field is used when the toner image on the outer surface of the transfer belt is transferred to the recording medium, deterioration of an image transferability due to the electric field or a poor electric field may be observed. The electric field used for the transfer is often involved in a surface layer that forms a transfer region in the transfer cylinder. Therefore, the present inventors studied a method of preventing a deterioration of the image transferability involved in the surface layer while maintaining the replaceability of the surface layer, and thus found a configuration of the transfer devices according to the first and second exemplary embodiments.

That is, the transfer device according to the first and second exemplary embodiments achieves both the replaceability and the image transferability of the surface layer in the transfer cylinder.

Transfer Unit

The transfer unit in the transfer device according to the first and second exemplary embodiments will be described.

Each of the transfer units in the first and the second exemplary embodiments has the transfer cylinder that has: the base material; the surface layer wound around the outer circumference of the base material and replaceable with respect to the base material; and a transfer region where the toner image is transferred from the transfer belt to the recording medium in a state where the recording medium is sandwiched between the transfer cylinder and the outer surface of the transfer belt.

It is good that the transfer unit further includes a rotary body disposed on each of both ends of the transfer cylinder in an axial direction. Here, the rotary body is a member involved in transporting the recording medium to the transfer region together with a circulating member and a holder, which will be described later.

Transfer Cylinder

Each of the transfer cylinders in the first and second exemplary embodiments includes the base material; the surface layer wound around the outer circumference of the base material and replaceable with respect to the base material. Each of the transfer cylinders in the first and the second exemplary embodiments has a transfer region where the toner image is transferred from the transfer belt to the recording medium in a state where the recording medium is sandwiched between the transfer cylinder and the outer surface of the transfer belt.

Base Material

Examples of the base material in the transfer cylinder include a columnar member or a cylindrical member formed of a metal (such as copper, aluminum, zinc, chromium, nickel, molybdenum, vanadium, indium, gold, and platinum) or an alloy (such as stainless steel).

One or more recesses in which a holder involved in transporting the recording medium is accommodated, which will be described later may be formed on the outer circumference of the base material (transfer cylinder).

An outer diameter (diameter) of the base material is not particularly limited, and may be large because the surface layer is replaceable. The outer diameter (diameter) of the base material is, for example, 200 mm or more and 350 mm or less, and preferably 200 mm or more and 300 mm or less.

A length of the base material in an axial direction is also not particularly limited and may be appropriately selected depending on use and is, for example, 600 mm or more and 1000 mm or less.

The outer diameter of a conductive base material with respect to a thickness of the surface layer or the elastic layer is preferably 30 times or more, more preferably 30 times or more and 45 times or less, and further preferably 32 times or more and 38 times or less.

Surface Layer

The surface layer of the transfer cylinder is wound around the outer circumference of the base material and is replaceable with respect to the base material.

Hereinafter, the surface layer in the first exemplary embodiment and the surface layer in the second exemplary embodiment will be described separately.

Surface Layer in First Exemplary Embodiment

The surface layer (hereinafter, referred to as a surface layer (1)) according to the first exemplary embodiment includes an elastic layer and has a surface roughness Rz of 25 μm or less, an Asker C hardness of 45° or more and 65° or less, a volume resistance of 6.0 (log Ω) or more and 8.5 (log Ω) or less, and a thickness of 10 mm or less.

The surface layer (1) includes at least the elastic layer. The surface layer (1) may include: an external surface layer forming the outermost surface, an adhesive layer, and the like, in addition to the elastic layer. That is, a layer forming the outermost surface of the surface layer (1) may be an elastic layer or an external surface layer.

The surface layer (1) has a surface roughness Rz of 25 μm or less (preferably, 20 μm or less, and more preferably, 10 μm or less).

A toner may be attached to the surface of the transfer cylinder (that is, the surface of the surface layer).

When the surface roughness Rz of the surface layer (1) is 25 μm or less, the surface may be cleaned more easily in combination with cleaning with the cleaning brush, and the back surface of the recording medium may more effectively be prevented from being stained.

A lower limit of the surface roughness Rz of the surface layer (1) is preferably 1 μm.

The surface roughness Rz of the surface layer indicates a ten-point mean roughness Rz measured in accordance with JIS B 0601: 1994.

The surface roughness Rz (ten-point mean roughness Rz) of the surface layer is determined as follows.

The surface roughness Rz is measured using a contact-type surface roughness measuring device (SURFCOM 570A, manufactured by TOKYO SEIMITSU CO., LTD.) and a contact needle with a diamond tip (5 μmR, 90° cone) in an environment at a temperature of 23° C. and a humidity of 55% RH.

Setting a measurement distance to 2.5 mm and measurement positions in the surface layer to 80 positions at equal intervals in the plane on the surface layer (for example, 8 points at equal intervals in a circulation direction, 10 points at equal intervals in an axial direction, and the same applies hereinafter), an average value thereof is obtained as the surface roughness Rz of the surface layer.

The surface layer (1) has an Asker C hardness of 45° or more and 65° or less.

In the transfer device in the first exemplary embodiment, an electric field is formed between the transfer cylinder and the facing roller member in the transfer region in the transfer cylinder to transfer the toner image of the outer surface of the transfer belt to the recording medium. In this case, in the transfer region, it is possible to improve the image transferability (specifically, improve a transfer efficiency and prevent a transfer disturbance) by applying an appropriate transfer load to the recording medium.

When the Asker C hardness of the surface layer (1) is 45° or more, an appropriate transfer load may be applied to the recording medium in the transfer region, and the transfer efficiency is improved. More specifically, the Asker C hardness of the surface layer (1) is 45° or more (preferably 550 or more). Accordingly, even when a transport speed of the recording medium in the transfer region is 600 mm/s or higher, an appropriate transfer load may be applied to the recording medium in the transfer region, and the transfer efficiency is improved.

In addition, the Asker C hardness of the surface layer (1) is 65° or less. Accordingly, an impact when the recording medium (specifically, a stiffness strong recording medium such as thick paper) enters the transfer region may be cushioned, and the transfer disturbance caused by such a collision is prevented. More specifically, when the Asker C hardness of the surface layer (1) is 650 or less (preferably 60° or less), even when using a recording medium having a basis weight of 200 gsm (g/m$^2$) or more, it is possible to prevent the transfer disturbance caused by the impact when entering the transfer region.

The Asker C hardness of the surface layer is determined as follows.

Measurements are performed on 80 positions at equal intervals in the plane on the surface layer with a DE FACTO STANDARD ASKER C-type durometer manufactured by KOBUNSHI KEIKI CO., LTD., and an average value thereof is determined as the Asker C hardness of the surface layer. The measurement is performed in an environment at a temperature of 23° C. and a humidity of 55% RH.

The surface layer (1) has a volume resistance of 6.0 (log Ω) or more and 8.5 (log Ω) or less.

As described above, in the transfer device in the first exemplary embodiment, an electric field is formed between the transfer cylinder and the facing roller member, in the transfer region in the transfer cylinder to transfer a toner image on the outer surface of the transfer belt to a recording medium. In this case, since discharge occurs in the transfer region according to the applied voltage, the volume resistance of the surface layer (1) has a large effect on the image transferability.

When the volume resistance of the surface layer (1) is 6.0 (log Ω) or more, it becomes easy to prevent a local transfer defect (so-called a white spot) due to discharge in the transfer region, and image transferability is improved. In addition, when the volume resistance is 8.5 (log Ω), self-elimination of the surface layer (1) becomes possible, and it becomes easy to prevent a ghost that occurs when electric charge history of the surface layer (1) affects the electric field at the time of subsequent transfer and the image transferability is improved.

The volume resistance of the surface layer is determined as follows.

First, 80 measurement samples are prepared by cutting out predetermined 80 positions on the surface layer. 80 Measurement samples are measured using a circular electrode (for example, UR PROBE OF HI-LESTER IP manufactured by Mitsubishi Chemical Corporation) in accordance with JIS K 6911: 1995, and an average value thereof is determined as the volume resistance of the surface layer. In the measurement, the current value after applying a voltage of 500 V for 10 seconds under a temperature of 22° C. and a humidity of 55% RH is determined, and the volume resistance is calculated.

The surface layer (1) has a thickness of 10 mm or less.

The surface layer (1) is a conductive layer, as is clear from the above-mentioned volume resistance. When the thickness of the conductive layer is large, it is difficult to uniformly carry out cross-linking (specifically, vulcanization) in manufacturing, and the uniformity of the distribution of conductive points may be lowered due to the influence. Further, since the surface layer (1) is thick, it becomes difficult to attach the surface layer (1) to the base material in terms of weight, shape maintenance, and the like, and the replaceability of the surface layer may be lowered. For example, when the surface layer (1) is thick, it becomes difficult to align the surface layer (1) with the outer circumference of the base material when the surface layer (1) is attached to the base material, and the adhesion to the base material may decrease.

When the thickness of the surface layer (1) is 10 mm or less, the uniformity of the distribution of the conductive points is improved, excellent image transferability is obtained, and the replaceability with respect to the base material is also improved. A lower limit of the thickness of the surface layer (1) is preferably 6.5 mm.

The thickness of the surface layer (1) is preferably 8 mm or less, and more preferably 6.5 mm or more and 7.5 mm or less, from the viewpoint of the image transferability and the replaceability.

The thickness of the surface layer is determined as follows.

Measurements are performed on 80 positions at equal intervals in the plane on the surface layer using an eddy current film thickness meter CTR-1500E manufactured by Sanko Electronics Co., Ltd., and the average value is determined as the surface layer thickness. The measurement is performed in an environment at a temperature of 23° C. and a humidity of 55% RH.

As the surface layer (1), from the viewpoint of achieving both the replaceability and the image transferability of the surface layer in the transfer cylinder, it is preferable that the surface layer of the transfer cylinder has the surface roughness Rz of 10 μm or less, the Asker C hardness of 55° or more and 60° or less, the volume resistance of 6.5 (log Ω) or more and 8.0 (log Ω) or less, and the thickness of 6.5 mm or more and 7.5 mm or less.

Composition of Elastic Layer in Surface Layer (1)

The elastic layer in the surface layer (1) contains an elastic material, and preferably contains various additives as necessary such as a conductive agent from the viewpoint of achieving each of the above-mentioned physical properties.

The elastic layer in the surface layer (1) may be a foamed elastic layer, a non-foamed elastic layer, or a stacked structure of the foamed elastic layer and the non-foamed elastic layer. Here, the foamed elastic layer is a layer formed of a material (so-called foam) having bubbles formed by foaming of a foaming agent. The non-foamed elastic layer is a layer formed of a material (so-called non-foam) having no bubbles formed by foaming of the foaming agent.

Elastic Material

Examples of the elastic material include nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluororubber, natural rubber, and elastic materials as mixtures thereof.

Among these elastic materials, polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, acrylonitrile-butadiene rubber, and the elastic materials as mixtures thereof are preferable.

Conductive Agent

Examples of the conductive agent include an electronic conductive agent and an ionic conductive agent.

Examples of the electronic conductive agent include powders such as carbon black such as furnace black, thermal black, channel black, ketjen black, acetylene black, and color black; pyrolysis carbon; graphite; metals or alloys such as aluminum, copper, nickel, and stainless steel; metal oxides such as tin oxide, indium oxide, titanium oxide, tin oxide-antimony oxide solid solution, and tin oxide-indium oxide solid solution; and a substance obtained by conductive-treating the surface of an insulating material.

Examples of the ionic conductive agent include perchlorates or chlorates such as tetraethylammonium, lauryltrimethylammonium, and benzyltrialkylammonium; and perchlorate or chlorate of alkali metals such as lithium and magnesium or alkaline earth metals.

As the conductive agent, one kind may be used alone, or two or more kinds thereof may be used in combination.

The conductive agent favorably has a primary particle diameter of 1 nm or more and 200 nm or less.

The content of the electronic conductive agent is preferably 1 part by weight or more and 30 parts by weight or less, and more preferably 15 parts by weight or more and 25 parts by weight or less with respect to 100 parts by weight of the elastic material.

The content of the ionic conductive agent is preferably 0.1 part by weight or more and 5 parts by weight or less, and more preferably 0.5 parts by weight or more and 3 parts by weight or less with respect to 100 parts by weight of the elastic material.

Vulcanizing Agent and Vulcanization Accelerator

The elastic layer in the surface layer (1) may contain a vulcanizing agent.

Examples of the vulcanizing agent include sulfur, organic sulfur-containing compounds, and organic peroxides. Examples of the organic sulfur-containing compound include tetramethylthiuram disulfide, N, N'-dithiobismorpholine, and the like. Examples of the organic peroxide include dicumyl peroxide and benzoyl peroxide.

As the vulcanizing agent, one kind may be used alone, or two or more kinds may be used in combination.

The amount of the vulcanizing agent added may be appropriately adjusted according to the characteristics of the elastic material (rubber material) to be used, for example, is preferably 0.3 parts by weight or more and 10 parts by weight or less and more preferably 1 part by weight or more and 8 parts by weight or less with respect to 100 parts by weight of the elastic material.

The elastic layer in the surface layer (1) may contain a vulcanization accelerator.

As the vulcanization accelerator, a known vulcanization accelerator is used, and it is particularly favorable to use a sulfenamide-based vulcanization accelerator.

As the vulcanization accelerator, one kind may be used alone or two or more kinds thereof may be used in combination.

The amount of the vulcanization accelerator added is preferably 0.3 parts by weight or more and 4 parts by weight or less, and more preferably 0.5 parts by weight or more and 3 parts by weight or less with respect to 100 parts by weight of the elastic material.

Other Additives

The elastic layer in the surface layer (1) may contain other additives.

Examples of other additives include various known additives for rubber. Specific examples thereof include processing aids (such as stearic acid), softeners, plasticizers, curing agents, antioxidants, surfactants, coupling agents, and fillers (such as silica and calcium carbonate).

When the surface layer (1) contains a foamed elastic layer, the surface layer (1) may contain a foaming aid, a foam stabilizer, a catalyst, or the like as other additives.

Foaming Agent

When the surface layer (1) includes a foamed elastic layer, the composition for forming the foamed elastic layer may contain a foaming agent.

Examples of the foaming agent include water; azo compounds such as azodicarbonamide, azobisisobutyronitrile and diazoaminobenzene; benzenesulfonyl hydrazides such as benzenesulfonylhydrazide, 4,4'-oxybisbenzenesulfonylhydrazide, and toluenesulfonylhydrazide; bicarbonates such as sodium hydrogen carbonates that generate carbon dioxide by thermal decomposition; a mixture of $NaNO_2$ and $NH_4Cl$ that generates nitrogen gas; and peroxides that generate oxygen.

As the foaming agent, one kind may be used alone, or two or more kinds thereof may be used in combination.

The amount of the foaming agent added may be appropriately adjusted according to the characteristics, the foaming amount, or the like of the elastic material to be used, for example, is preferably 0.1 part by weight or more and 30 parts by weight or less, more preferably 0.5 parts by weight or more and 20 parts by weight or less, further preferably 1 part by weight or more and 15 parts by weight or less, and particularly preferably 2 parts by weight or more and 10 parts by weight or less, with respect to the 100 parts by weight of the elastic material.

Formation of Elastic Layer in Surface Layer (1)

The formation of the elastic layer in the surface layer (1) is not particularly limited. For example, the elastic layer is favorably formed in a manner that an elastic layer-forming composition containing an elastic material, a conductive agent, and a vulcanizing agent is molded into a desired shape and then vulcanized, or is vulcanized while molded into a desired shape.

When forming the foamed elastic layer, for example, an elastic layer-forming composition containing a foaming agent in addition to the elastic material, the conductive agent, and the vulcanizing agent may be used.

Further, an elastic body may be molded by the above method using the above-mentioned elastic layer-forming composition, and then stretched into a sheet shape, which may be used as an elastic layer in the surface layer (1).

After vulcanization (or vulcanization and foaming), the formed elastic layer may be polished, if necessary.

Vulcanization and foaming for obtaining the foamed elastic layer may be performed simultaneously or sequentially. When the vulcanization and foaming are carried out sequentially, it is favorable to carry out vulcanization and then foaming.

The temperature and time during vulcanization and foaming are not particularly limited and may be appropriately set according to the vulcanization and foaming agent used.

Vulcanization and/or foaming is favorably carried out by heating, and the heating temperature is preferably 50° C. or higher and 200° C. or lower. The vulcanization time is, for example, 15 minutes or more and 60 minutes or less.

The foamed elastic layer may be formed with a physical foaming agent such as an inert gas. As the inert gas, it is favorable to use carbon dioxide, nitrogen, or a mixture thereof in a supercritical state.

The foaming method used for forming the foamed elastic layer is not particularly limited, and specific examples thereof include a batch foaming method, a press foaming method, an atmospheric pressure foaming method, a normal pressure second foaming method, and a method such as steam pressure heating foaming in a vulcanizer.

As the foaming agent used for forming the foamed elastic layer and the foaming method, it is possible to see the foaming agent and the foaming method described in JP-A-11-106543 or "New Edition: Basics of Rubber Technology Revised Edition", edited by Japan Rubber Association.

External Surface Layer in Surface Layer (1)

The surface layer (1) may have an external surface layer forming the outermost surface.

The external surface layer in the surface layer (1) favorably contains a polymer material.

Examples of the polymer material include resins such as acrylic resin, fluorine-modified acrylic resin, silicone modified acrylic resin, cellulose resin, polyamide resin, polyurethane resin, polycarbonate resin, polyester resin, polyimide resin, epoxy resin, silicone resin, polyvinyl alcohol resin, polyvinyl butyral resin, cellulose resin, polyvinyl acetal resin, ethylene tetrafluoroethylene resin, melamine resin, polyethylene resin, polyvinyl resin, polyarylate resin, polythiophene resin, polyethylene terephthalate resin (PET), and fluororesin (polyvinylidene fluoride resin, ethylene tetrafluoride resin, a tetrafluoroethylene-perfluoroalkyl vinyl ether copolymer (PFA), and tetrafluoroethylene-hexafluoropropylene copolymer (FEP)). Further, these resins are favorably those obtained by curing or cross-linking a curable resin with a curing agent or a catalyst.

As the polymer material, one kind may be used alone, or two or more kinds may be used in combination.

The external surface layer may contain a conductive agent from the viewpoint of resistance control.

Examples of the conductive agent include the same conductive agents used for the elastic layer described above.

As the conductive agent, one kind may be used alone, or two or more kinds may be used in combination.

The external surface layer may also contain other known additives such as fillers, hardeners, antioxidants, surfactants, coupling agents, and the like.

The thickness of the external surface layer may be determined according to the physical properties required for the surface layer (1) and is not particularly limited. The thickness of the external surface layer may be appropriately set to 1 μm or more and 100 μm or less, for example.

Surface Layer in Second Exemplary Embodiment

Further, the surface layer (hereinafter, referred to as a surface layer (2)) according to the second exemplary embodiment has a foamed conductive elastic layer and a non-foamed conductive elastic layer in order from a base material side, and a thickness of the foamed conductive elastic layer is larger than a thickness of the non-foamed conductive elastic layer.

The surface layer (2) includes at least a foamed conductive elastic layer and a non-foamed conductive elastic layer. The surface layer (2) may include an external surface layer forming the outermost surface, an adhesive layer, and the like, in addition to the foamed conductive elastic layer and the non-foamed conductive elastic layer. That is, a layer forming the outermost surface of the surface layer (2) may be a non-foamed conductive elastic layer or an external surface layer.

When the surface layer (2) has the above configuration, the hardness of the surface layer (2) may be controlled by the foamed conductive elastic layer disposed on the base material side, and the surface roughness of the surface layer (2) may be reduced by the non-foamed conductive elastic layer disposed on the surface side.

When reducing the surface roughness of the surface layer (2), it becomes easy to clean the surface of the surface layer (2) with a cleaning member as in the surface layer (1), and it becomes easy to prevent stains on the back surface of the recording medium.

When the foamed conductive elastic layer having a lower hardness than that of the non-foamed conductive elastic layer is disposed on the base material side and a thickness of the foamed conductive elastic layer is set to be larger than that of the non-foamed conductive elastic layer, the hardness of the surface layer (2) may be controlled to be moderately soft. As a result, in the surface layer (2), similarly to the surface layer (1), an appropriate transfer load may be applied to the recording medium in the transfer region, and the transfer efficiency may be improved. Further, the surface layer (2) may cushion an impact when the recording medium (specifically, a stiffness strong recording medium such as thick paper) enters the transfer region and prevent transfer disturbance caused by such a collision.

The surface roughness Rz of the surface layer (2) is preferably 25 μm or less, more preferably 20 μm or less, and further preferably 10 μm or less.

In order to achieve the surface roughness Rz, it is favorable that the thickness of the non-foamed conductive elastic layer and the thickness of the foamed conductive elastic layer have a relationship which will be described later.

In the surface layer (2), a ratio of the thickness of the non-foamed conductive elastic layer to the thickness of the surface layer (2) (or to total of the thickness of the foamed conductive elastic layer and the thickness of the non-foamed conductive elastic layer) is preferably 5% or more and 10% or less.

The thickness of the non-foamed conductive elastic layer and the thickness of the foamed conductive elastic layer are measured by the same method as the thickness of the surface layer (1).

The surface layer (2) includes the foamed conductive elastic layer and the non-foamed conductive elastic layer, and preferably has a volume resistance of 6.0 (log Ω) or more and 8.5 (log Ω) or less (preferably 6.5 (log Ω) or more and 7.5 (log Ω) or less).

The surface layer (2) includes a foamed conductive elastic layer and a non-foamed conductive elastic layer, and the thickness thereof is preferably 10 mm or less, more preferably 8 mm or less, and further preferably 6.5 mm or more and 7.5 mm or less.

Composition of Elastic Layer in Surface Layer (2)

The elastic layer in the surface layer (2) includes a foamed conductive elastic layer and a non-foamed conductive elastic layer, and it is favorable that both the foamed conductive elastic layer and the non-foamed conductive elastic layer contain an elastic material, and as necessary, various additives such as a conductive agent, from the viewpoint of achieving each of the above-mentioned physical properties.

As the components such as the elastic material and the conductive agent contained in each of the foamed conductive elastic layer and the non-foamed conductive elastic layer, those having the same composition as that of the elastic layer in the surface layer (1) are used, and same applies to an exemplary embodiment and an addition amount (content).

Formation of Elastic Layer in Surface Layer (2)

The formation of the elastic layer in the surface layer (2) is not particularly limited as long as a stack structure of the foamed conductive elastic layer and the non-foamed conductive elastic layer is formed. A method similar to the formation of the surface layer (1) is used for forming each of the foamed conductive elastic layer and the non-foamed conductive elastic layer.

When forming the stack structure, for example, a method of separately preparing a sheet-shaped foamed conductive elastic layer and a sheet-shaped non-foamed conductive elastic layer and bonding the two together may be mentioned.

When the foamed conductive elastic layer and the non-foamed conductive elastic layer are bonded together, for example, a conductive adhesive is used.

External Surface Layer in Surface Layer (2)

The surface layer (2) may have an external surface layer forming the outermost surface.

As the external surface layer in the surface layer (2), the same one as the external surface layer in the surface layer (1) is used, and an exemplary embodiment is also the same.

Rotary Body

In addition to the transfer cylinder described above, the transfer units in the first and second exemplary embodiments favorably include rotary bodies disposed on both ends in the axial direction of the transfer cylinder.

The rotary body and the circulating member and the holder, which will be described later, have a function of holding and transporting the recording medium on the outer circumference of the transfer cylinder.

Details of the functions, arrangements, and the like of the rotary body, the circulating member, and the holder will be described later.

Cleaning Brush Member

The transfer device according to the first and second exemplary embodiments favorably includes a cleaning brush member for cleaning the surface of the transfer cylinder described above.

Examples of the material of the brush fibers in the cleaning brush member include resin fibers such as nylon, acryl, polypropylene, and polyester.

Here, a penetration depth of the cleaning brush member into the surface of the transfer cylinder is preferably 1 mm or more, and more preferably 1.2 mm or more.

When the transfer cylinder is cleaned with such a penetration depth of the cleaning brush member, the removability of toner on the surface of the transfer cylinder (that is, the surface having a small surface roughness Rz as shown in the surface layers (1) and (2)) is improved.

Here, the penetration depth of the cleaning brush member is determined by difference between the distance between an axis of the cleaning brush member and an axis of the transfer cylinder and a value obtained by adding the radius of the cleaning brush member in the no-load state to the radius of the cleaning brush member in the no-load state.

In particular, when the length of the brush (brush fiber) of the cleaning brush member is preferably 4 mm or more, and more preferably 6 mm or more.

The thickness of the brush fibers in the cleaning brush member is preferably 2 denier or more and 10 denier or less, and more preferably 4 denier or more and 6 denier or less.

Further, the brush fiber density in the cleaning brush member is preferably about $60\times10^3$ fiber/inch$^2$ or more and $100\times10^3$ fiber/inch$^2$ or less.

The transfer device according to the first and second exemplary embodiments may include a cleaning blade member in place of the cleaning brush member or together with the cleaning brush member.

That is, as the cleaning member for cleaning the surface of the transfer cylinder, a cleaning blade may be used, or a cleaning brush member and a cleaning blade member may be used in combination.

Transfer Belt

A transfer belt in the transfer device according to the first and second exemplary embodiments is an annular belt member on which the toner image is transferred to the outer surface.

The transfer belt is not particularly limited as long as it is an annular belt member on which the toner image may be transferred to the outer surface, and a so-called intermediate transfer belt may be applied.

The transfer belt may also be, for example, a belt member having a stack structure including an elastic layer (preferably a conductive elastic layer) forming the outer surface (for example, outer circumference), and a base material disposed on the inner circumferential side of the elastic layer to form the inner surface (for example, inner circumference) thereof. The elastic layer and the base material of the transfer belt may be disposed so as to be in direct contact with each other at the interface thereof, or may be disposed via another layer such as an adhesive layer between them.

Further, the transfer belt may be a belt member having a single layer structure composed of only an elastic layer (preferably a conductive elastic layer).

The elastic layer of the transfer belt contains an elastic material similar to the surface layers (1) and (2) described above, and favorably contains various additives such as a conductive agent as necessary, from the viewpoint of achieving physical properties required for the transfer belt.

Facing Roller Member

The facing roller member in the transfer device according to the first and second exemplary embodiments is a roller member that comes into contact with the inner surface of the transfer belt and is disposed so as to face the transfer cylinder in the above-mentioned transfer region.

The facing roller member is not particularly limited as long as it is a member capable of forming an electric field with the transfer cylinder in the transfer region, and a so-called secondary transfer roller may be applied.

The facing roller member is in press-contact with the transfer cylinder in the transfer region, and by changing the press-contact condition, an appropriate transfer load may be applied to the recording medium. Therefore, specifically, the facing roller member favorably has a conductive elastic layer in a base material (also referred to as a shaft) made of a metal, an alloy, or the like.

The conductive elastic layer of the facing roller member contains an elastic material similar to the surface layers (1) and (2) described above, and favorably contains various additives such as a conductive agent as necessary, from the viewpoint of achieving physical properties required for the facing roller member.

Here, the volume resistance of the facing roller member is preferably 7.0 (log Ω) or more and 8.0 (log Ω) or less from the viewpoint of preventing image defects caused by discharge in the transfer region.

The volume resistance of the facing roller member is determined as follows.

After the base material of the facing roller member is grounded and the roller electrode is circumscribed so as to face the facing roller member, a voltage is applied to the roller electrode, and the volume resistance is measured from the current flowing between the facing roller member and the roller electrode.

Image Forming Apparatus Subsequently, referring to FIG. 1 showing an example of an image forming apparatus including a transfer device according to the first and second exemplary embodiments, the transfer device according to the first and second exemplary embodiments and the image forming apparatus including this transfer device (that is, an image forming apparatus according to the exemplary embodiments) will be described. Here, FIG. 1 is a schematic view showing the configuration of an image forming apparatus 10 according to the present exemplary embodiment.

Image Forming Apparatus 10

The image forming apparatus 10 shown in FIG. 1 is an example of an image forming apparatus that forms an image on a recording medium. Specifically, the image forming apparatus 10 is an electrophotographic image forming apparatus that forms a toner image (an example of an image) on a recording medium P. More specifically, the image forming apparatus 10 includes an image forming unit 14, a transport unit 15, and a fixing device 16. Hereinafter, each part of the image forming apparatus 10 (the image forming unit 14, the transport unit 15, and the fixing device 16) will be described.

Image Forming Unit 14

The image forming unit 14 has a function of forming a toner image on the recording medium P. Specifically, the image forming unit 14 includes a toner image forming unit 22 and a primary and secondary transfer unit 17.

Toner Image Forming Unit 22

Plural toner image forming units 22 shown in FIG. 1 form toner images of the respective colors. In the present exemplary embodiment, a total of four color toner image forming units 22 of yellow (Y), magenta (M), cyan (C), and black (K) are provided. (Y), (M), (C), and (K) shown in FIG. 1 indicate components corresponding to the above colors.

In the image forming apparatus 10, when it is necessary to distinguish between yellow (Y), magenta (M), cyan (C), and black (K), (Y), (M), (C), and (K) are added after the reference numerals of the respective members, and (Y), (M), (C), and (K) may be omitted when it is not necessary to distinguish each color. Further, since the toner image forming unit 22 of each color has the same configuration except for the toner to be used, each part of the toner image forming unit 22 (Y) is denoted by a reference numeral in FIG. 1 on behalf of the toner image forming unit 22 of each color.

Specifically, the toner image forming unit 22 of each color has a photoconductor drum 32 (photoconductor) that rotates in one direction (for example, the counterclockwise direction in FIG. 1). Further, the toner image forming unit 22 of each color includes a charger 23, an exposure device 36, a developing device 38, and a removing device 40.

In the toner image forming unit 22 of each color, the charger 23 causes the charging of the photoconductor drum 32. Further, in the exposure device 36, the photoconductor drum 32 charged by the charger 23 is exposed to form an electrostatic latent image on the photoconductor drum 32. The developing device 38 develops the electrostatic latent image formed on the photoconductor drum 32 by the exposure device 36 to form a toner image. The removing device 40 removes the toner remaining on the photoconductor drum 32 after the transfer of the toner image to a transfer belt 24 described later.

Primary and Secondary Transfer Unit 17

The primary and secondary transfer unit 17 shown in FIG. 1 is a unit that transfers the toner image formed by the toner image forming unit 22 to the recording medium P. Specifically, the primary and secondary transfer unit 17 superimposes the toner images of the photoconductor drums 32 of each color on the transfer belt 24 as an intermediate transfer body for primary transfer, and secondarily transfers the superimposed toner images to the recording medium P at a secondary transfer position T2 (nip region 28A which will be described later). More specifically, as shown in FIG. 1, the primary and secondary transfer unit 17 includes the transfer belt 24, a primary transfer roller 26, a secondary transfer body 27, and a secondary transfer roller 60.

Here, in the primary and secondary transfer unit 17, a configuration which includes the transfer belt 24, the secondary transfer body 27, and the secondary transfer roller 60, and involved in the secondary transfer corresponds to an example of a transfer device according to the first and second exemplary embodiments.

Transfer Belt 24

The transfer belt 24 shown in FIG. 1 is an example of an annular transfer belt on which an image is transferred to an outer surface. Specifically, in the transfer belt 24, the toner image is transferred from the photoconductor drum 32 of each color to the outer circumferential surface (an example of the outer surface). More specifically, the transfer belt 24 is configured as follows. The transfer belt 24 has an annular shape as shown in FIG. 1. Further, the transfer belt 24 is wound around plural rollers 42 including a drive roller 42D to determine the posture. The transfer belt 24, for example, circulates in a predetermined direction of arrow A (hereinafter, referred to as a belt circulation direction A) by rotationally driving the drive roller 42D among plural rollers 42 by a drive unit (not shown).

Primary Transfer Roller 26

The primary transfer roller 26 shown in FIG. 1 is a roller that transfers the toner image on the photoconductor drum 32 for each color to the transfer belt 24 at primary transfer positions T1 between the photoconductor drum 32 and the primary transfer roller 26. A primary transfer electric field is formed between the primary transfer roller 26 and the photoconductor drum 32, so that the toner image formed on the photoconductor drum 32 is transferred to the transfer belt 24 at the primary transfer position T1.

Secondary Transfer Body 27

Figure 2:
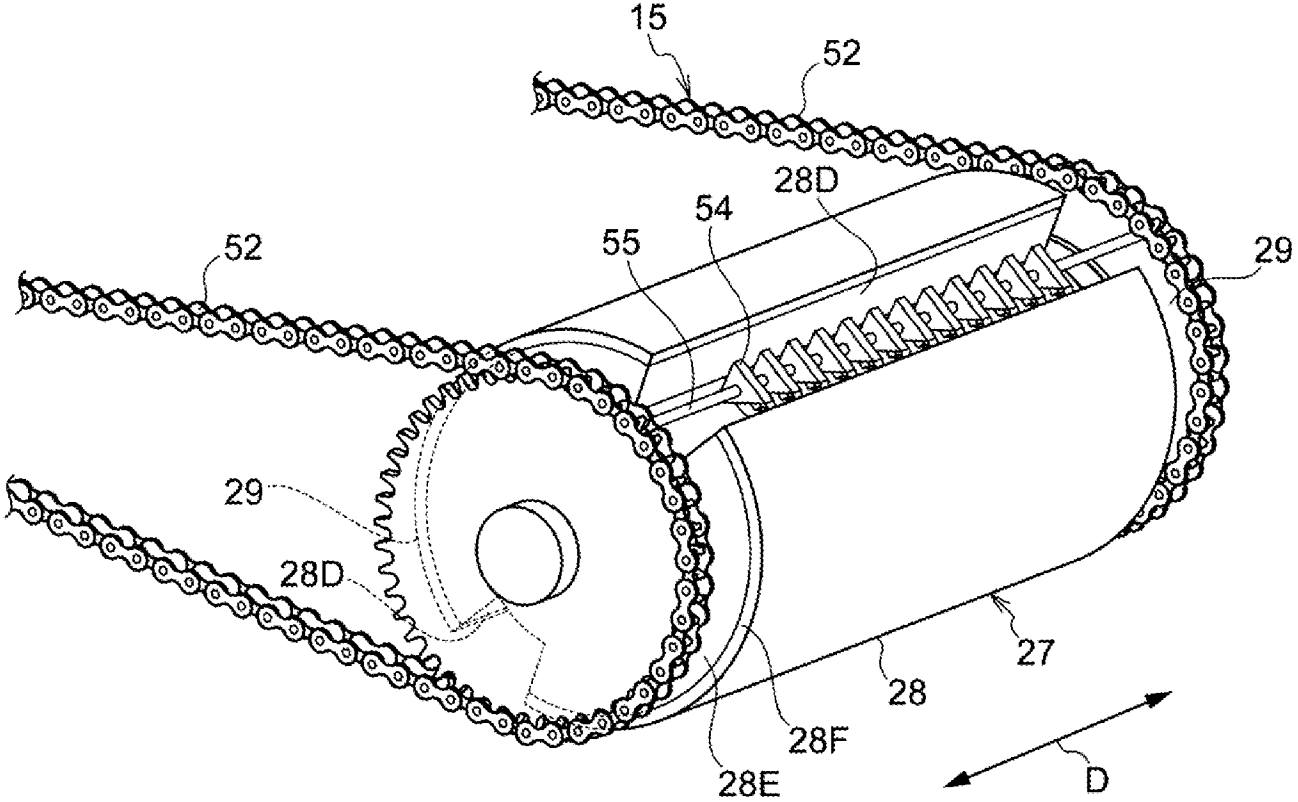
FIG. 2 is an enlarged perspective view showing a secondary transfer portion of the image forming apparatus according to the exemplary embodiment.
Figure 3:
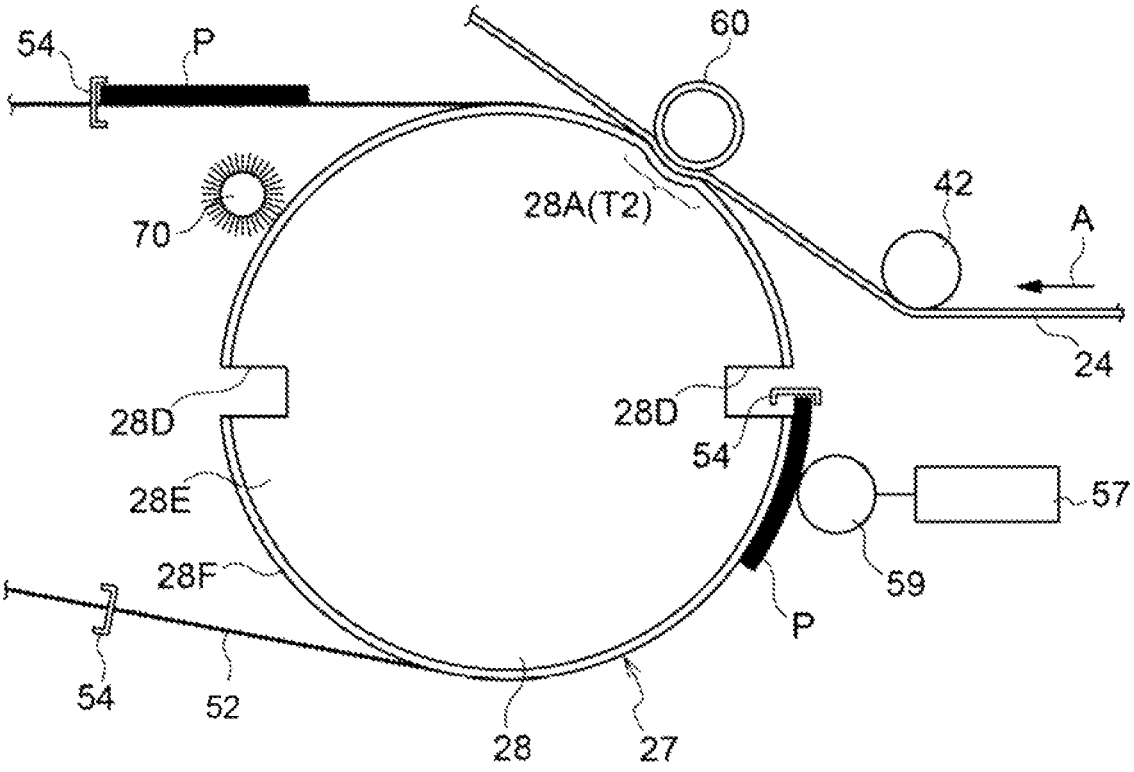
FIG. 3 is an enlarged side view showing the secondary transfer portion of the image forming apparatus according to the exemplary embodiment.

The secondary transfer body 27 is an example of a transfer unit, and specifically, as shown in FIG. 2, has a transfer cylinder 28 and a pair of sprockets 29. The transfer cylinder 28 is an example of a transfer cylinder having a transfer region where an image is transferred from the transfer belt to a recording medium in a state where the recording medium is sandwiched between the transfer cylinder and the outer surface of the transfer belt. Specifically, as shown in FIG. 3, the transfer cylinder 28 has a nip region 28A (an example of a transfer region) that sandwiches the recording medium P with the outer circumferential surface of the transfer belt 24. The nip region 28A is a region where the recording medium P is sandwiched, and thus may be said to be a sandwiching region. The transfer cylinder 28 sandwiches the recording medium P with the transfer belt 24, and thus may be said to be a sandwiching portion. In FIG. 3, the recording medium P is simplified and only the front end portion is shown, and the recording medium P is sandwiched between the transfer cylinder 28 and the transfer belt 24 in the nip region 28A.

The nip region 28A is formed by winding the transfer belt 24 around the transfer cylinder 28. In other words, the nip region 28A may be said to be a contact region where the transfer belt 24 and the transfer cylinder 28 come into contact with each other. The nip region 28A is a secondary transfer position T2 at which the toner image is transferred from the transfer belt 24 to the recording medium P. Further, the transfer cylinder 28 is transported by sandwiching the recording medium P with the transfer belt 24 in the nip region 28A.

The pair of sprockets 29 is an example of a rotary body. As shown in FIG. 2, the pair of sprockets 29 are disposed on both ends in the axial direction of the transfer cylinder 28. In other words, the transfer cylinder 28 is provided between the pair of sprockets 29. Further, the pair of sprockets 29 is disposed coaxially of the transfer cylinder 28, and is configured to rotate integrally with the transfer cylinder 28. The secondary transfer body 27 is rotationally driven by a drive unit (not shown).

Figure 5:
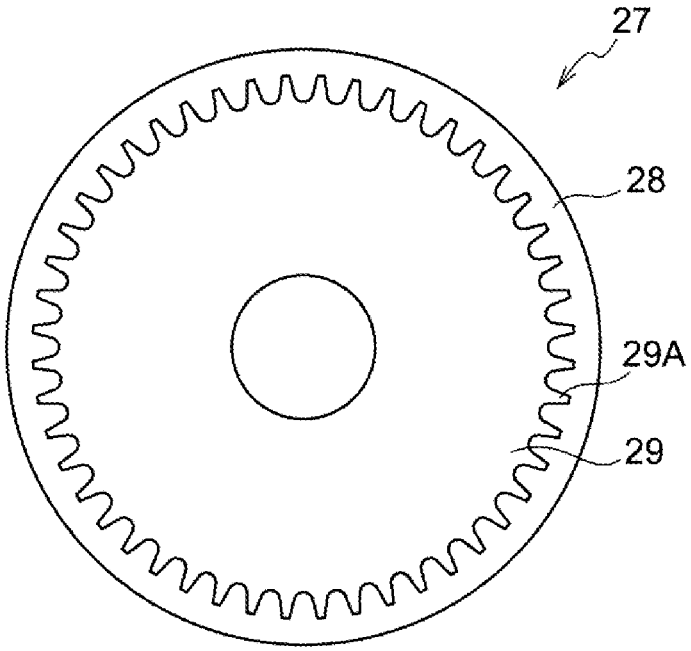
FIG. 5 is a side view showing a rotary body according to the exemplary embodiment.

As shown in FIG. 5, the outer diameter of the pair of sprockets 29 is smaller than the outer diameter of the transfer cylinder 28. The outer diameter of the sprocket 29 is the outer diameter including teeth 29A (that is, the diameter of the tooth tip).

Further, as shown in FIG. 2, the transfer cylinder 28 has a base material 28E and a surface layer 28F that is wound around the outer circumference of the base material 28E and replaceable with respect to the base material 28E.

Details such as the configuration and composition of the base material 28E and the surface layer 28F are as described above. In the case of the first exemplary embodiment, the surface layer 28F is the surface layer having the above-mentioned surface roughness Rz, Asker C hardness, volume resistance, and thickness. In the case of the second exemplary embodiment, the surface layer 28F has a stack structure having a foamed conductive elastic layer and a non-foamed conductive elastic layer in this order from the base material 28E side.

Further, two recesses 28D in which a gripper 54 and an attachment member 55 described later of the transport unit 15 are accommodated are formed on the outer circumference of the transfer cylinder 28 (that is, the outer circumference of the base material 28E). The number of recesses 28D may be one or three or more.

Secondary Transfer Roller 60

Figure 4:
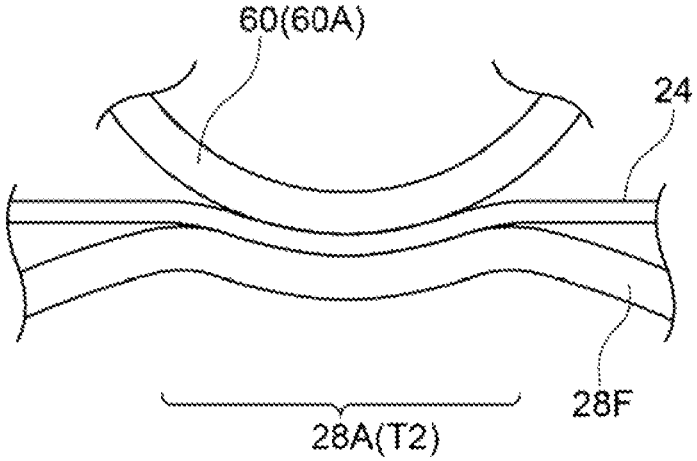
FIG. 4 is a further-enlarged side view showing the secondary transfer portion shown in FIG. 3.

The secondary transfer roller 60 shown in FIG. 1 is an example of a facing roller member that comes into contact with the inner surface of the transfer belt 24 and faces the transfer cylinder 28 the transfer region of the transfer cylinder 28. As shown in FIG. 3, the secondary transfer roller 60 is disposed inside the transfer belt 24 so as to face the transfer cylinder 28. In this case, the secondary transfer roller 60 is pressed against the transfer cylinder 28, and as shown in FIG. 4, the region where the surface layer 28F of the transfer cylinder 28 is deformed becomes the nip region 28A (secondary transfer position T2).

Further, a secondary transfer electric field is formed between the secondary transfer roller 60, the transfer belt 24, and the transfer cylinder 28, so that the toner image superimposed on the transfer belt 24 is transferred from the transfer belt 24 to the recording medium P in the nip region 28A (secondary transfer position T2).

The details of the structure of the secondary transfer roller 60 (specifically, the structure including the conductive elastic layer) are as described above.

Cleaning Brush 70

For the purpose of cleaning the surface of the transfer cylinder 28 (specifically, for the purpose of removing the toner or the like attached to the surface of the transfer cylinder 28), a cleaning brush 70 (an example of a cleaning brush member) is disposed to contact the outer circumference of the transfer cylinder 28 (that is, the surface of the surface layer 28F).

The cleaning brush 70 rotates, so that toner and the like on the surface of the transfer cylinder 28 are scraped off, and the surface of the transfer cylinder 28 is cleaned. At this time, the penetration depth of the cleaning brush 70 into the surface of the transfer cylinder 28 is favorably 1 mm or more.

The details of the cleaning brush 70 are as described above.

Transport Unit 15

The transport unit 15 shown in FIGS. 1 to 3 and the like has a function of transporting the recording medium P. Specifically, the transport unit 15 has a function of transporting the recording medium P and passing it through the nip region 28A (see FIG. 3). More specifically, as shown in FIGS. 1 and 2, the transport unit 15 has a pair of sprockets 19, a pair of chains 52, a gripper 54, and a suction roller 59. The pair of chains 52 is an example of a circulating member. The gripper 54 is an example of a holder that holds a recording medium. In FIG. 1, the sprocket 19, the chain 52, and the gripper 54 are shown in a simplified manner. Further, in FIG. 3, the chain 52 and the gripper 54 are shown in a simplified manner.

As shown in FIG. 1, the pair of sprockets 19 are disposed on the fixing device 16 side (left side in FIG. 1) with respect to the pair of sprockets 29 of the secondary transfer body 27 at intervals in the front-rear direction of the device. The pair of sprockets 19 are coaxially and integrally rotatable and supported by an apparatus body (not shown) of the image forming apparatus 10.

The pair of chains 52 are formed in an annular shape as shown in FIG. 1. As shown in FIG. 2, the pair of chains 52 are disposed at intervals in the front-rear direction of the device (D direction in FIG. 2). The pair of chains 52 are wound around a pair of sprockets 29 and the pair of sprockets 19 (see FIG. 1) of the secondary transfer body 27, respectively. Then, the transfer cylinder 28 having the pair of sprockets 29 rotates, so that the chain 52 circulates in the circulation direction C (direction of arrow C in FIG. 1). Here, the chain 52 is wound so as to straddle at least a region of the nip region 28A facing the secondary transfer roller 60 in the circulation direction C. As a result, since the recording medium P is transported by the chain 52 during the secondary transfer, the speed fluctuation of the recording medium P is prevented at the secondary transfer position T2. Further, the chain 52 is wound so as to straddle the entire nip region 28A. The winding angle at which the chain 52 is wound around the sprocket 29 is preferably 90 degrees or more, and is 180 degrees or more in the present exemplary embodiment. Therefore, the recording medium P is easily transported following the surface of the transfer cylinder 28. In order for the recording medium P to be easily transported following the surface of the transfer cylinder 28, it is desirable that the winding angle is 90 degrees or more. Further, in the present exemplary embodiment, in the circulation direction C, the winding angle from the start of winding the chain 52 to the arrival at the secondary transfer position T2 is 90 degrees or more.

In the present exemplary embodiment, the chain 52 travels between the transfer belt 24 and the transfer cylinder 28 downstream of the nip region 28A in the transport direction in a side view. In other words, the chain 52 has a gap with respect to a winding portion in a side view, and has a gap with respect to the transfer cylinder 28 on the side opposite to the winding portion with respect to the chain 52.

As shown in FIG. 2, the attachment member 55 to which the gripper 54 is attached is hung on the pair of chains 52 along the front-rear direction of the device. Plural attachment members 55 are fixed to the pair of chains 52 at predetermined intervals along the circumferential direction (circulation direction C) of the chain 52.

Figure 6:
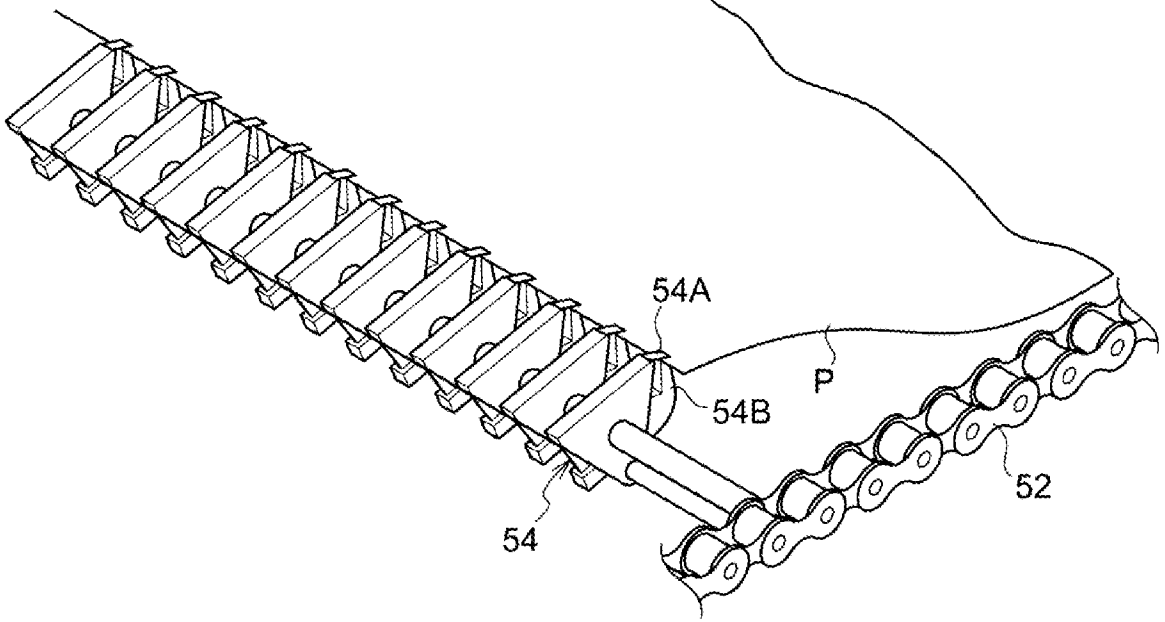
FIG. 6 is a perspective view showing a gripper according to the exemplary embodiment.

As shown in FIG. 2, plural grippers 54 are attached to the attachment member 55 at predetermined intervals along the front-rear direction of the device. In other words, the gripper 54 is attached to the chain 52 via the attachment member 55. The gripper 54 has a function of holding the front end portion of the recording medium P. Specifically, the gripper 54 has a pawl 54A and a pawl base 54B as shown in FIG. 6. The gripper 54 is configured to hold the recording medium P by sandwiching the front end portion of the recording medium P between the pawl 54A and the pawl base 54B. In other words, the gripper 54 may be said to be an example of a sandwiching unit that sandwiches the recording medium P in the thickness direction.

More specifically, the gripper 54 holds the front end portion of the recording medium P in the image area outside of the recording medium P. An image area of the recording medium P and a region of the recording medium P where the toner image is transferred. In the gripper 54, for example, the pawl 54A is pressed against the pawl base 54B by a spring or the like, and the pawl 54A is opened and closed with respect to the pawl base 54B by the action of a cam or the like.

Then, in the transport unit 15, the front end portion of the recording medium P sent from an accommodating unit (not shown) in which the recording medium P is accommodated is held by the gripper 54 as shown in FIG. 6. Further, the transport unit 15 circulates the chain 52 in the circulation direction in a state where the gripper 54 holds the front end portion of the recording medium P, so that the gripper 54 is moved to transport the recording medium P, and the recording medium P passes through the nip region 28A together with the gripper 54 while the recording medium P is held by the gripper 54. Further, the transport unit 15 transports the recording medium P to the fixing device 16 after passing through the nip region 28A.

The suction roller 59 is in contact with the transfer cylinder 28 upstream of the nip region 28A in the transport direction. The suction roller 59 presses the recording medium P against the transfer cylinder 28 and charges the recording medium P by supplying power from a power source 57. As a result, the recording medium P is electrostatically attracted to the outer circumferential surface of the transfer cylinder 28.

Fixing Device 16

The fixing device 16 shown in FIG. 1 is a device that fixes the toner image transferred to the recording medium P by the transfer cylinder 28 to the recording medium. More specifically, as shown in FIG. 1, the fixing device 16 has a heating roller 68 as a heating member and a pressurizing roller 69 as a pressurizing member. In the fixing device 16, the heating roller 68 and pressurizing roller 69 apply heat and pressure to the recording medium P, so as to fix the toner image formed on the recording medium P to the recording medium P.

The movement of the recording medium P and the transfer of the toner image to the recording medium P in the image forming apparatus 10 shown in FIG. 1 will be described.

First, as shown in FIG. 6, the front end portion of the recording medium P sent from the accommodating unit (not shown) in which the recording medium P is accommodated is held by the gripper 54. Further, the chain 52 circulates in the circulation direction C in a state where the gripper 54 holds the front end portion of the recording medium P, so that the gripper 54 is moved to transport the recording medium P, and the recording medium P passes through the nip region 28A together with the gripper 54 while the recording medium P is held by the gripper 54 (see FIG. 3). The recording medium P is electrostatically attracted to the transfer cylinder 28 by the suction roller 59 upstream of the nip region 28A in the transport direction.

When the recording medium P passes through the nip region 28A, the recording medium P is electrostatically attracted to the transfer belt 24 and the transfer cylinder 28 by the discharge of a discharge wire 60A in the secondary transfer roller 60. Further, the discharge of the discharge wire 60A of the secondary transfer roller 60 transfers the toner image superimposed on the transfer belt 24 from the transfer belt 24 at the nip region 28A (secondary transfer position T2) to the recording medium P.

The recording medium P is attached to the transfer cylinder 28 and the transfer belt 24 by being sandwiched between the transfer belt 24 and the transfer cylinder 28 in the nip region 28A. Then, for example, the transfer belt 24 is separated from the recording medium P, so that the recording medium P is separated from the transfer belt 24.

Modification Example in Transfer Device

In the exemplary embodiment shown in FIGS. 1 and 3, one secondary transfer roller 60 is provided, but a configuration may include two or more secondary transfer rollers 60 (an example of a facing roller member), and the secondary transfer roller 60 and another charger (for example, non-contact charger) may be disposed side by side.

Other Modification Examples

Further, in the exemplary embodiment shown in FIG. 3, the gripper 54 as an example of the holder holds the front end portion of the recording medium P, but the present disclosure is not limited thereto. For example, as an example of the holder, a gripper that holds the side end portion of the recording medium P may be used.

Further, in the exemplary embodiment shown in FIG. 2, the chain 52 is used as an example of the circulating member, but the present disclosure is not limited thereto. For example, as an example of the circulating member, a timing belt may be used.

Further, in the exemplary embodiment shown in FIG. 6, a sprocket 29 is used as an example of the rotary body, but the present disclosure is not limited thereto. For example, as an example of a rotary body, a timing pulley around which a timing belt is wound may be used.

In the exemplary embodiment shown in FIG. 1, the fixing device 16 has a configuration including the heating roller 68 and the pressurizing roller 69, but is not limited to the configuration.

As the fixing device 16, a known fixing device may be applied.

The present disclosure is not limited to the above-described exemplary embodiment, and various modifications, changes, and improvements may be made within a range that does not deviate from the gist thereof. For example, the above-mentioned modification examples may be combined as appropriate.

Examples

Hereinafter, exemplary embodiments of the disclosure will be described in detail with reference to Examples, but the exemplary embodiments of the disclosure are not limited to these Examples. In the following description, unless otherwise specified, "parts" are based on weight.

Preparation of Transfer Cylinder

Preparation of Base Material

An aluminum base material having an outer diameter of 243 mm and having one recess having a width of 100 mm is prepared.

Preparation of Surface Layer

The surface layer is prepared as follows.

The elastic layer-forming composition containing an elastic material and additives such as a conductive agent, a vulcanizing agent, and a foaming agent is prepared, and the elastic layer-forming composition is placed in a mold, vulcanized, foamed, and molded to prepare the foamed conductive elastic body. The obtained foamed conductive elastic body is pressed and stretched into a sheet to obtain a sheet-shaped foamed conductive elastic layer.

Further, an elastic layer-forming composition containing an elastic material and additives such as a conductive agent and a vulcanizing agent is prepared, and is placed in a mold. Then, vulcanization, foaming, and molding are performed to prepare a non-foamed conductive elastic body. The obtained non-foamed conductive elastic body is pressed and stretched into a sheet to obtain a sheet-shaped non-foamed conductive elastic layer.

The obtained sheet-shaped foamed conductive elastic layer and the sheet-shaped non-foamed conductive elastic layer are attached with a conductive adhesive to obtain an elastic layer having a stack structure.

Here, in the elastic layer-forming composition, as the elastic material, one or more of the above-mentioned various elastic materials are used, and one or more of the above-mentioned various additives are used as the additive.

After polishing the surface of the non-foamed conductive elastic layer in the obtained elastic layer, an external surface layer described above is formed on the non-foamed conductive elastic layer to obtain a surface layer.

Attachment of Surface Layer

The surface layer prepared as described above is attached to the outer circumference of the base material as follows.

First, a front end portion of the surface layer is attached to the base material, the base material is rotated while pressing the surface layer against the base material, the surface layer is brought into close contact with the outer circumference of the base material, and finally a rear end portion of the surface layer is fixed.

Preparation of Other Transfer Cylinders

Various transfer cylinders having at least one difference in surface roughness, Asker C hardness, volume resistance, and thickness are prepared by the same method as in the preparation of the transfer cylinder described above except that preparation conditions for the surface layer are appropriately changed.

The changed preparation conditions for the surface layer include the following.

The surface roughness is controlled by changing, for example, the surface roughness of the mold, the polishing conditions, and the like.

The Asker C hardness is controlled by changing, for example, the kind of elastic material, the blending amount of the curing agent, and the like.

The volume resistance is controlled by changing, for example, the kind of the conductive agent, the blending amount, and the like.

The thickness is controlled by changing the size of the mold, the pressurizing conditions when stretching into a sheet, and the like.

Evaluation

The transfer cylinder obtained as described above is incorporated, and the following evaluation is performed using an image forming apparatus having the configuration shown in FIG. 1.

Evaluation of Surface Roughness Rz of Surface Layer of Transfer Cylinder

Images are formed using an image forming apparatus incorporating the followings as the transfer cylinder 28, the cleaning brush 70, and the secondary transfer roller 60, and the surface roughness Rz of the surface layer 28F of the transfer cylinder 28 is evaluated.

Here, as the transfer cylinder 28, five kinds of transfer cylinders are used each including a surface layer 28F having a surface roughness Rz of 40 μm, 35 μm, 22 μm, 10 μm, or 5 μm, an Asker C hardness of 50°, a volume resistance of 7 (log Ω), and a thickness of 7 mm.

As the cleaning brush 70, two kinds of brushes which are a brush (1) having a brush length of 6 mm, a brush fiber diameter of 2 denier, and a brush fiber density of $80\times10^3$ fiber/inch$^2$, and a brush (2) having a brush length of 6 mm, a brush fiber diameter of 6 denier, and a brush fiber density of $80\times10^3$ fiber/inch$^2$ or less are used.

Further, as the secondary transfer roller 60, a roller member having a conductive elastic layer having a volume resistance of 7.5 log Ω is used.

The conditions for image formation are as follows.

1,000 images with 10% image coverage of each color of Y, M, C, and K are printed.

The toner removability is evaluated as follows.

A fog toner in the paper non-passing portion may be directly attached to the surface layer 28F of the transfer cylinder 28. Regarding the toner attached in this manner, after the toner passes through the cleaning region by the cleaning brush 70, an amount of toner on the surface layer 28F is visually observed, and the evaluation result shows that the toner removability is enhanced as the toner amount decreases.

The results obtained as described above are shown in FIGS. 7 and 8.

Figure 7:
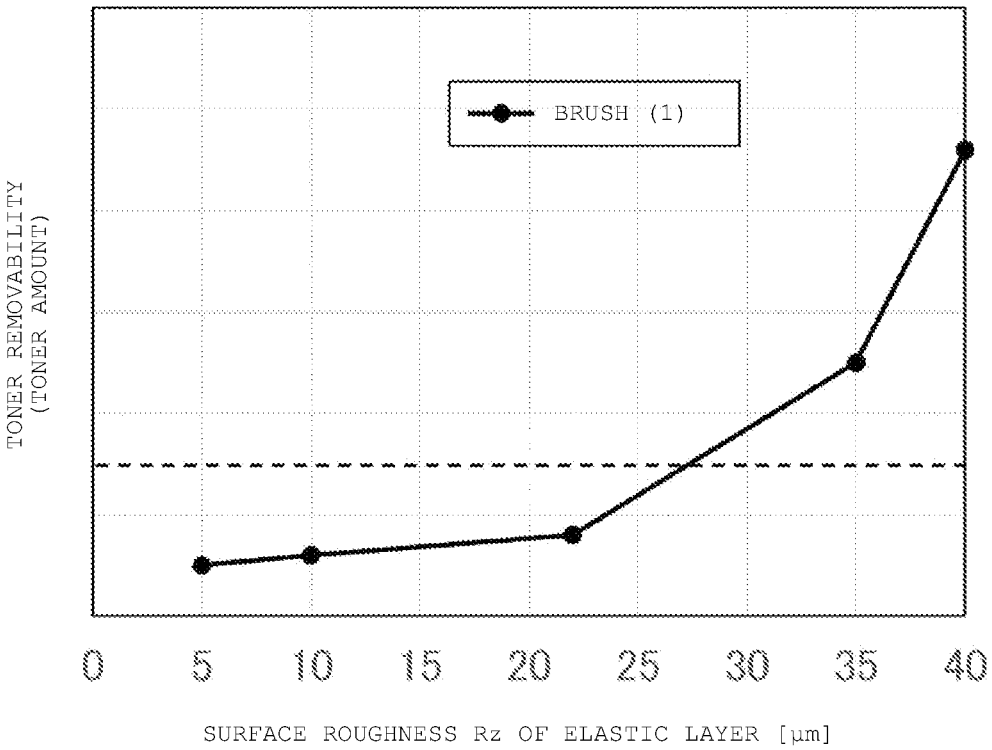
FIG. 7 is a graph showing a relationship between a surface roughness Rz of a surface layer of a transfer cylinder and a toner removability.

FIG. 7 is a graph showing a relationship between a surface roughness Rz of a surface layer of a transfer cylinder and a toner removability, when the cleaning brush (1) is used and the penetration depth of the cleaning brush into the surface of the transfer cylinder is 1 mm.

Figure 8:
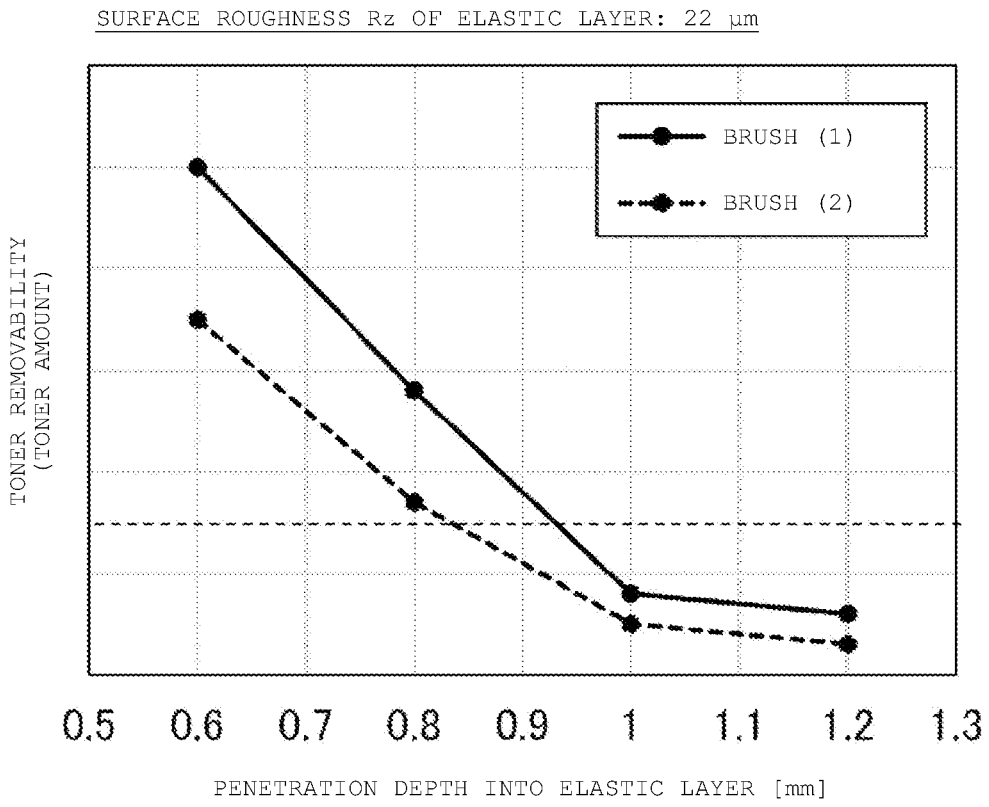
FIG. 8 is a graph showing a relationship between a penetration depth of a cleaning brush into a surface of the transfer cylinder and the toner removability.

FIG. 8 is a graph showing a relationship between a penetration depth of a cleaning brush into a surface of a transfer cylinder and the toner removability, when the cleaning brushes (1) and (2) are used and a transfer cylinder having a surface layer having a surface roughness Rz of 22 μm is used.

In FIGS. 7 and 8, the vertical axis indicates the amount of toner on the surface layer 28F of after passing through the cleaning region by the cleaning brush 70. FIGS. 7 and 8 shows that toner removability is enhanced as the toner amount decreases. In FIGS. 7 and 8, it is shown that the toner removability is excellent especially in the region below the dotted line.

According to the graph of FIG. 7, it may be seen that the toner removability by the cleaning member is excellent by using the transfer cylinder having the surface layer having the surface roughness Rz of 25 μm or less.

Further, according to the graph of FIG. 8, the toner removability is enhanced as the penetration depth of the cleaning brush into the surface of the transfer cylinder increases, and in particular, it may be seen that the toner removability is particularly improved by setting the penetration depth of the cleaning brush to 1 or more.

Evaluation of Asker C Hardness of Surface Layer of Transfer Cylinder

Images are formed using an image forming apparatus incorporating the following, that is, the transfer cylinder 28, the secondary transfer roller 60, and the cleaning brush 70, and the Asker C hardness of the surface layer of the transfer cylinder 28 is evaluated.

Here, as the transfer cylinder 28, five kinds of transfer cylinders each including a surface layer having an Asker C hardness of 35°, 45°, 55°, 65°, or 75°, a surface roughness Rz of 20 μm, a volume resistance of 7 (log Ω), and a thickness of 7 mm are used.

Further, as the cleaning brush 70, the above-mentioned brush (1) is incorporated with the penetration depth of the cleaning brush into the surface of the transfer cylinder set to 1 mm.

Further, as the secondary transfer roller 60, a roller member having a conductive elastic layer having a volume resistance of 7.5 log Ω is used.

The conditions for image formation are as follows.

1,000 images with 10% image coverage of each color of Y, M, C, and K are printed. As the recording medium, three kinds having a basis weight of 127 gsm, 350 gsm, or 470 gsm are used, and the transport speed of the recording medium in the transfer region is set to 560 mm/s or 800 mm/s.

The image on the obtained printed matter is visually observed to evaluate the image transferability.

Decrease in transfer efficiency is evaluated based on the presence or absence of reduction region of the image density and the size of the reduction region of the image density. In addition, the transfer disturbance is evaluated based on nonuniformity of image.

The evaluation criteria are as follows. Here, it is an acceptable level that the evaluation of image transferability is "G11" and "G12".

G11: Image transferability is good.

G12: Image transferability is good, although there is a slight decrease in transfer efficiency or transfer disturbance.

G21: A Transfer load is not sufficient, and the transfer efficiency is lowered.

G22: The transfer disturbance occurs due to an impact when a recording medium enters a transfer region (nip region).

G3: The transfer disturbance greatly occurs due to an impact when a recording medium enters a transfer region (nip region).

The evaluation results of image transferability are shown in Tables 1 and 2 below.

Table 1 shows a relationship between the Asker C hardness and image transferability of the surface layer of the transfer cylinder, when a recording medium having a basis weight of 127 gsm, 350 gsm, or 470 gsm is used and the transport speed of the recording medium in the transfer region is 560 mm/s.

Table 2 shows a relationship between the Asker C hardness and image transferability of the surface layer of the transfer cylinder, when a recording medium having a basis weight of 127 gsm, 350 gsm, or 470 gsm is used and the transport speed of the recording medium in the transfer region is 800 mm/s.

TABLE 1

Transport Speed of Recording Medium: 560 mm/s

| | | Asker C Hardness of Surface Layer in Transfer Cylinder [°] | | | | |
|---|---|---|---|---|---|---|
| | | 35 | 45 | 55 | 65 | 75 |
| Basis Weight of Recording Medium [gms] | 127 | G21 | G12 | G11 | G12 | G12 |
| | 350 | G21 | G12 | G11 | G12 | G22 |
| | 470 | G21 | G12 | G11 | G12 | G55 |

TABLE 2

| Transport Speed of Recording Medium: 800 mm/s | | | | | | |
|---|---|---|---|---|---|---|
| | | Asker C Hardness of Surface Layer in Transfer Cylinder [°] | | | | |
| | | 35 | 45 | 55 | 65 | 75 |
| Basis Weight of Recording Medium [gms] | 127 | G21 | G12 | G11 | G12 | G12 |
| | 350 | G21 | G12 | G11 | G12 | G3 |
| | 470 | G21 | G12 | G11 | G12 | G3 |

According to Table 1 and Table 2, when the Asker C hardness is 45° or more and 65° or less, regardless of the transport speed of the recording medium, and regardless of the basis weight of the recording medium, it is found that a good image transferability may be obtained.

Evaluation of Volume Resistance of Surface Layer of Transfer Cylinder Images are formed using an image forming apparatus incorporating the following, that is, the transfer cylinder 28, the secondary transfer roller 60, and the cleaning brush 70, and the volume resistance of the surface layer of the transfer cylinder 28 is evaluated.

Here, as the transfer cylinder 28, eight kinds of transfer cylinders each having a surface layer having a volume resistance of 5.5 (log Ω), 6.0 (log Ω), 6.5 (log Ω), 7.0 (log Ω), 7.5 (log Ω), 8.0 (log Ω), 8.5 (log Ω), or 9.0 (log Ω), a surface roughness Rz of 20 μm, an Asker C hardness of 50°, and a thickness of 7 mm are used.

As the secondary transfer roller 60, five kinds of roller members including a conductive elastic layer having a volume resistance of 6.5 (log Ω), 7.0 (log Ω), 7.5 (log Ω), 8.0 (log Ω), or 8.5 (log Ω) are used.

Further, as the cleaning brush 70, the above-mentioned brush (1) is incorporated with the penetration depth of the cleaning brush into the surface of the transfer cylinder set to 1 mm.

The conditions for image formation are as follows.

1,000 images with 10% image coverage of each color of Y, M, C, and K are printed.

The obtained image is visually observed and image defects due to image transferability are evaluated.

The evaluation criteria are as follows. Here, it is an acceptable level that the image defects are "G11", "G12", "G21", and "G22".

G11: The image transferability is good, and a white spot or a ghost are not seen.

G12: The image transferability is good, and the white spots and ghosts are not seen or very few.

G21: The white spots and ghosts are not seen or very few, but graininess of the image is slightly low.

G22: The white spots and ghosts are not seen or very few, but some image defects due to discharge splattering are generated.

G31: The white spot is generated.

G32: The ghost is generated.

G41: The white spot is generated, and the graininess of the image is also low.

G42: The ghost is generated and the graininess of the image is also low.

G43: The white spot is generated, and an image defect due to splattering discharge is also generated.

G44: The ghost is generated, and an image defect due to splattering discharge is also generated.

The evaluation results of image defects are shown in Table 3 below.

Table 3 shows a relationship among the volume resistance of the surface layer of the transfer cylinder, the volume resistance of the secondary transfer roller (the volume resistance of the conductive elastic layer), and the image defect.

TABLE 3

| | | Volume Resistance of Surface Layer in Transfer Cylinder [logΩ] | | | | | | | |
|---|---|---|---|---|---|---|---|---|---|
| | | 5.5 | 6.0 | 6.5 | 7.0 | 7.5 | 8.0 | 8.5 | 9.0 |
| Volume Resistance of Second Transfer Roller [logΩ] | 6.5 | G41 | G21 | G21 | G21 | G21 | G21 | G21 | G42 |
| | 7.0 | G31 | G12 | G11 | G11 | G11 | G12 | G12 | G32 |
| | 7.5 | G31 | G12 | G11 | G11 | G11 | G12 | G12 | G32 |
| | 8.0 | G31 | G12 | G11 | G11 | G11 | G12 | G12 | G32 |
| | 8.5 | G43 | G22 | G22 | G22 | G22 | G22 | G22 | G44 |

According to Table 3, it may be seen that when the volume resistance of the surface layer of the transfer cylinder is 6.0 (log Ω) or more and 8.5 (log Ω) or less, an image in which white spot and ghosts are prevented may be obtained.

In particular, when the volume resistance of the secondary transfer roller is 7.0 (log Ω) or more and 8.0 (log Ω) or less, it may be seen that an image with fewer image defects may be obtained.

Evaluation of Thickness of Surface Layer of Transfer Cylinder

To evaluate the thickness of the surface layer of the transfer cylinder, transfer cylinders each including a respective one of seven surface layers are used. The seven surface layers have a surface roughness Rz of 20 μm, an Asker C hardness of 50°, and a volume resistance of 7 (log Ω). The seven surface layers have thicknesses of 15 mm, 13 mm, 11 mm, 9 mm, 7 mm, 5 mm, and 3 mm, respectively.

The volume resistance unevenness of the obtained transfer cylinder is measured as follows.

Using the method of measuring the volume resistance of the surface layer described above, volume resistance is measured at 80 positions at equal intervals in the plane, difference between the maximum and minimum is calculated from the measurement values obtained, difference is evaluated as the volume resistance unevenness.

When the value of the volume resistance unevenness is 0.1 (log Ω) or less, it indicates that the distribution of the conductive points is highly uniform (that is, the resistance uniformity of the surface layer of the transfer cylinder is high).

The winding property of the obtained transfer cylinder is evaluated as follows.

After printing 1,000 sheets using the transfer cylinder obtained by winding the surface layer, floating, misalignment, or the like of the surface layer are confirmed.

The result of the volume resistance unevenness obtained as described above is shown in FIG. 9.

Figure 9:
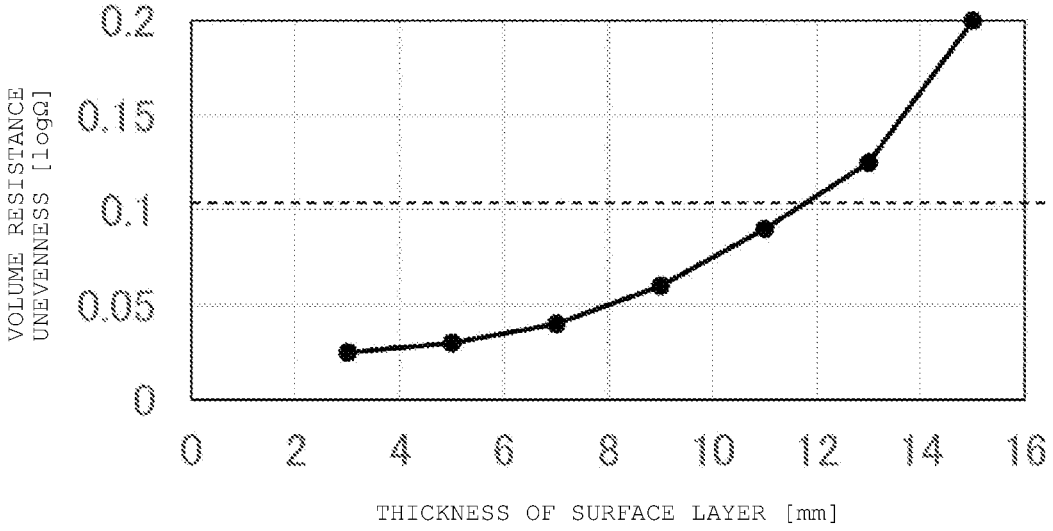
FIG. 9 is a graph showing a relationship between a thickness of the surface layer of the transfer cylinder and a volume resistance unevenness.

FIG. 9 is a graph showing the relationship between the thickness of the surface layer of the transfer cylinder and the volume resistance unevenness.

According to the graph of FIG. 9, it is considered that by using a transfer cylinder having a surface layer having a thickness of 10 mm or less, the distribution of conductive points on the surface layer is highly uniform, and as a result, excellent image transferability may be obtained.

Further, in the case of a transfer cylinder having a surface layer having a thickness of 10 mm or less, after printing 1,000 sheets, no floating or misalignment of the surface layer is confirmed, and it is found that the adhesion between the base material and the surface layer is excellent. As described above, since the winding with excellent adhesion between the base material and the surface layer may be performed, it may be seen that the replaceability of the surface layer is also excellent.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:
an annular transfer belt comprising an outer surface, a toner image being transferred to the outer surface of the annular transfer belt;
a transfer unit comprising a transfer cylinder; and
a facing roller member that is in contact with an inner surface of the transfer belt, wherein
the transfer cylinder comprises
a base material, and
a surface layer wound around an outer circumference of the base material, the surface layer being replaceable with respect to the base material,
the transfer cylinder has a transfer region where the toner image is transferred from the transfer belt to a recording medium in a state where the recording medium is sandwiched between the transfer cylinder and the outer surface of the transfer belt,
the surface layer comprises an elastic layer,
the surface layer has
a thickness of 6.0 mm or more and 10 mm or less, and an Asker C hardness of 45° or more and 65° or less, and
the facing roller member faces the transfer cylinder in the transfer region.

2. The transfer device according to claim 1, wherein the surface layer has the thickness of 6.5 mm or more and 7.5 mm or less.

3. The transfer device according to claim 1, wherein the surface layer has the Asker C hardness of 55° or more and 60° or less.

4. The transfer device according to claim 1, wherein the surface layer of the transfer cylinder has a surface roughness Rz of 25 μm or less.

5. The transfer device according to claim 4, wherein the surface layer of the transfer cylinder has the surface roughness Rz of 10 μm or less.

6. The transfer device according to claim 1, wherein the surface layer has a volume resistance of 6.0 (log Ω) or more and 8.5 (log Ω) or less.

7. The transfer device according to claim 6, wherein the surface layer has the volume resistance of 6.5 (log Ω) or more and 7.5 (log Ω) or less.

8. The transfer device according to claim 1, wherein the facing roller member has a volume resistance of 7.5 (log Ω) or more and 8.0 (log Ω) or less.

9. The transfer device according to claim 1, further comprising:
a cleaning brush member configured to clean a surface of the transfer cylinder, wherein
a penetration depth of the cleaning brush member into the surface of the transfer cylinder is 1 mm or more.

10. The transfer device according to claim 9, wherein a brush length of the cleaning brush member is 4 mm or more.

11. The transfer device according to claim 1, wherein
the transfer unit comprises rotary bodies disposed on both ends of the transfer cylinder in an axial direction,
the transfer device further comprising
circulating members wound around the rotary bodies, the circulating members being configured to circulate by a rotation of the rotary body, and
a holder attached to the circulating members, the holder being configured to hold the recording medium, and transport the recording medium by the circulation of the circulating members such that the recording medium passes through the transfer region.

12. The transfer device according to claim 11, wherein
a recess is formed on an outer circumference of the transfer cylinder, and
the recess is configured to accommodate the holder.

13. An image forming apparatus comprising:
the transfer device according to claim 12.

14. A transfer device comprising:
an annular transfer belt comprising an outer surface, a toner image being transferred to the outer surface of the annular transfer belt;
a transfer unit comprising a transfer cylinder; and
a facing roller member that is in contact with an inner surface of the transfer belt, wherein
the transfer cylinder comprises
a base material, and
a surface layer wound around an outer circumference of the base material, the surface layer being replaceable with respect to the base material,
the transfer cylinder has a transfer region where the toner image is transferred from the transfer belt to a recording medium in a state where the recording medium is sandwiched between the transfer cylinder and the outer surface of the transfer belt,
the surface layer comprises
a foamed conductive elastic layer, and
a non-foamed conductive elastic layer in order from a base material side,
a thickness of the foamed conductive elastic layer is larger than that of the non-foamed conductive elastic layer, and
the facing roller member faces the transfer cylinder in the transfer region.

* * * * *